US007882637B2

(12) United States Patent
Caby

(10) Patent No.: US 7,882,637 B2
(45) Date of Patent: Feb. 8, 2011

(54) METHOD OF OBTAINING A STRING OF PATTERNS, AND AN ARTICLE, IN PARTICULAR A PIECE OF JEWELRY, COMPRISING A STRING OF PATTERNS

(76) Inventor: Bruno Caby, 58-60 rue de la Py, 75020 Paris (FR)

( * ) Notice: Subject to any disclaimer, the term of this patent is extended or adjusted under 35 U.S.C. 154(b) by 692 days.

(21) Appl. No.: 11/632,723

(22) PCT Filed: Jul. 20, 2005

(86) PCT No.: PCT/FR2005/001857

§ 371 (c)(1),
(2), (4) Date: Jan. 18, 2007

(87) PCT Pub. No.: WO2006/021658

PCT Pub. Date: Mar. 2, 2006

(65) Prior Publication Data

US 2008/0032149 A1 Feb. 7, 2008

(30) Foreign Application Priority Data

Jul. 21, 2004 (FR) ..... 04 08061

(51) Int. Cl.
*A44C 27/00* (2006.01)

(52) U.S. Cl. ..... 29/896.11; 264/220

(58) Field of Classification Search ..... 63/5.1, 63/5.2, 15; 164/34, 35, 45, 235, 246, 3, 6; 29/896.4–896.43; 119/13; 199/69; 264/320, 264/220; 428/542.6, 542.2; D11/1, 5, 6, D11/11; 40/633; 24/68 J
See application file for complete search history.

(56) References Cited

U.S. PATENT DOCUMENTS

| | | | | |
|---|---|---|---|---|
| D334,900 | S * | 4/1993 | Bulgari | D11/5 |
| 5,880,430 | A | 3/1999 | Wein | |
| 6,003,228 | A | 12/1999 | Riggio | |
| 2006/0019041 | A1 * | 1/2006 | Good-Kruger et al. | 428/15 |

FOREIGN PATENT DOCUMENTS

| | | | |
|---|---|---|---|
| CA | 1 102 092 | A1 | 6/1981 |
| FR | 2 164 547 | A | 8/1973 |
| GB | 2 380 961 | A | 4/2003 |
| JP | 60-083740 | A | 9/1985 |
| JP | 05300807 | A * | 11/1993 |

OTHER PUBLICATIONS

Mann, Ganoksin, 'Online! 2005, XP002356053, Retrieved from the Internet: URL: www.ganoksin,com/borisat/nenam/michael-gerwig.htm, Nov. 25, 2005.

* cited by examiner

*Primary Examiner*—David P Bryant
*Assistant Examiner*—Jacob J Cigna
(74) *Attorney, Agent, or Firm*—Muncy, Geissler, Olds & Lowe, PLLC

(57) ABSTRACT

The invention relates to a method of obtaining a string of patterns, comprising the steps of:

hollowing out an impression (2) in a slab (1), the impression comprising a sequence of patterns touching one another;

causing a material (6) for taking the shape of the impression to penetrate into the impression so as to obtain a sequence of patterns (11) in relief;

stiffening the sequence of patterns to obtain a male shape (10) suitable for being molded; and making a molding of the male shape.

2 Claims, 4 Drawing Sheets

METHOD OF OBTAINING A STRING OF PATTERNS, AND AN ARTICLE, IN PARTICULAR A PIECE OF JEWELRY, COMPRISING A STRING OF PATTERNS

The invention relates to a method of obtaining a string of patterns, and to an article, in particular a piece of jewelry, comprising a string of patterns.

The term "string of patterns" is used herein to mean a one-piece article constituted by touching patterns, the patterns being hollowed out through their entire thickness in locations determined by their design. The structural strength of the string is provided by the connection between touching patterns. This is not merely engraving patterns on a plate.

The term "pattern" is used herein to mean any design of optionally alphanumeric type that can be represented in relief with solid portions and hollow portions.

BACKGROUND OF THE INVENTION

Jewelry is known made up of strings of patterns, such as, for example, curb chains comprising a sequence of touching alphabetic characters representing a forename. Such strings are machined from a plate of metal or they are cast.

The invention relates more particularly to strings of patterns of small size (a few millimeters). For such small sizes, machining strings of patterns is found to be very difficult. In addition, molding patterns so fine using a lost wax technique is impossible.

OBJECT OF THE INVENTION

An object of the invention is to provide a method of obtaining strings of patterns that can be implemented in very inexpensive manner and that can be used for producing any string of patterns.

The invention also provides an article, in particular a piece of jewelry, comprising a string of patterns.

BRIEF SUMMARY OF THE INVENTION

In order to achieve this object, the invention provides a method of obtaining a string of patterns, comprising the steps of:

hollowing out an impression in a slab, the impression comprising a sequence of patterns touching one another;

causing a material for taking the shape of the impression to penetrate into the impression so as to obtain a sequence of patterns in relief;

stiffening the sequence of patterns to obtain a male shape suitable for being molded; and making a molding of the male shape.

The male shape as stiffened in this way is thus made easy to handle. The stiffening makes it possible to mold the sequence of patterns, in particular using a lost wax technique. It is then possible to use metal to make strings of patterns with very small height.

In a first implementation of the method of the invention, the stiffening step comprises the operation of associating a backing plate with the sequence of patterns so that the sequence and the backing plate together form a male shape in which the sequence of patterns extends in relief from the backing plate.

Thus, the backing plate stiffens the sequence of patterns of the male shape. In addition, the backing plate makes it easier to inject liquid into the mold formed around the male shape by providing the option to have one or more feed points passing through the backing plate.

According to a particular aspect of the invention, the molding of the male shape provides a string of patterns that extend in relief from a base, with the base being cut away, at least in part. Thus, once molding has been performed, it is possible to obtain a string of patterns presenting a web only, or even no web at all if the base is eliminated completely, thereby providing interesting appearance effects, since the string of patterns as obtained in this way presents alternating solid portions and hollow portions.

In a second implementation of the method of the invention, the material for taking the shape of the impression is selected so as to provide a sequence of patterns that is deformable, and the stiffening step comprises the operation of deforming the sequence of patterns so as to cause edges of the sequence of patterns to face one another and so as to secure said edges to one another.

The string of patterns as worked in this way then forms a rigid male shape that can easily be molded.

The deformation preferably comprises the operation of winding the sequence of patterns to form a helix of touching turns, with the facing edges thereof being secured to one another.

BRIEF DESCRIPTION OF THE DRAWINGS

The invention can be better understood in the light of the following description given with reference to the figures of the accompanying drawings, in which.

DETAILED DESCRIPTION OF THE INVENTION

Figure 1:
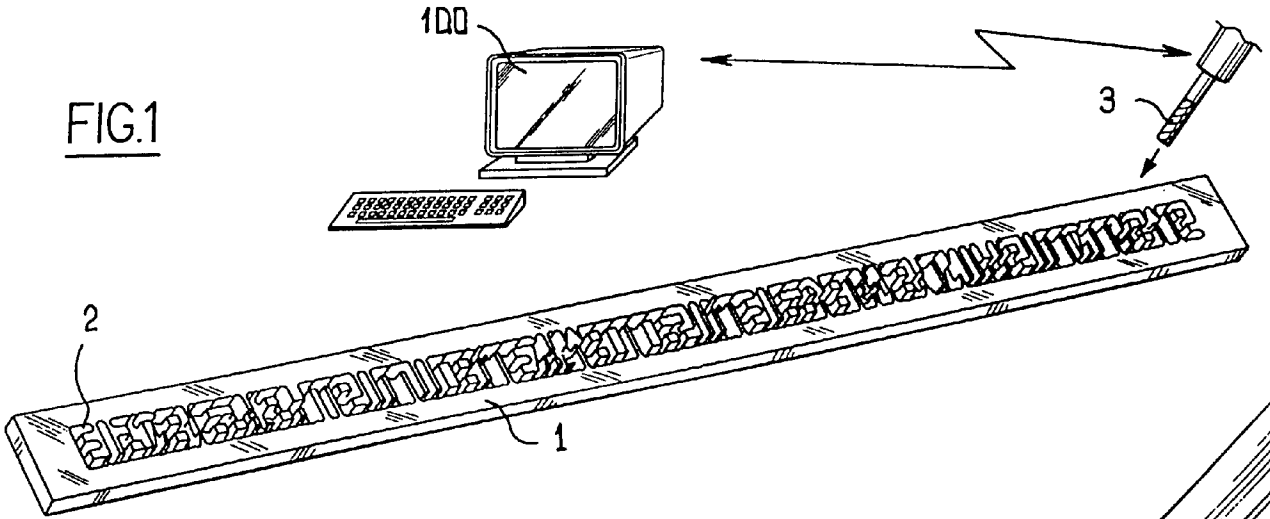
FIG. 1 is a perspective view of a slab in the form of a plate in which an impression has been made in order to implement the method of the invention in a first particular implementation thereof.

With reference to FIG. 1, and in a first particular implementation, the method of the invention comprises a step of hollowing out an impression 2 in a slab, in this case a plate 1 cut from an acetate sheet having a thickness of 2 millimeters. The width of the plate 1 is about 8 millimeters.

The impression 2 comprises a sequence of alphabetic patterns which are placed against one another so as to overlap slightly. The sequence of patterns is obtained by engraving the plate 1 by means of an engraving tool 3 (in this case a ball-tipped cutter having a diameter of 0.6 millimeters) that is moved by a computer 100 running a program for generating the path followed by the engraving tool 3 on the basis of a sequence of patterns, in this example letters typed into the keyboard of the computer 100. In this example, the patterns are 3 millimeters high.

Figure 2:
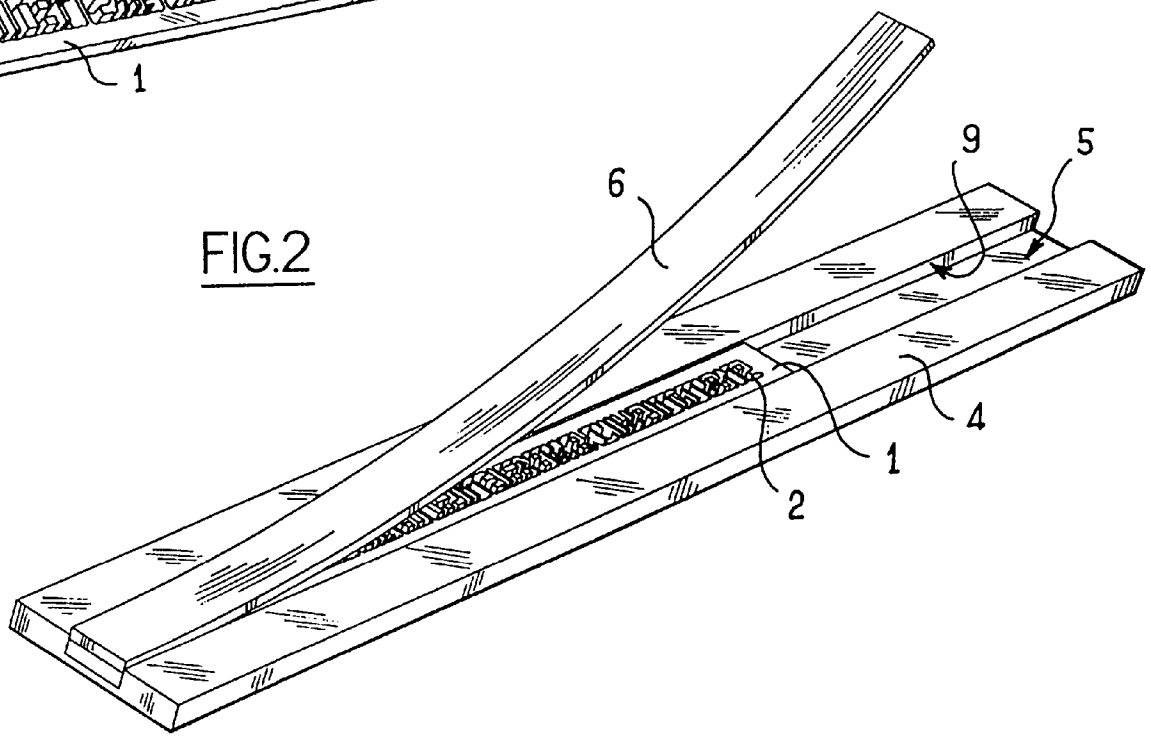
FIG. 2 is a perspective view of a molding jig in having the plate placed therein and with the strip of wax being positioned therein.

Thereafter, and as can be seen in FIG. 2, the plate 1 is placed in a jig 4 presenting a recess 5 that is deeper than the thickness of the plate 1.

The impression of the plate 1 is coated in an unmolding composition, for example a silicone oil.

Thereafter, a strip of wax 6 is applied to the plate 1, e.g. using the same kind of wax as is used in making dental prostheses, after it has been initially softened by being warmed a little.

It should be observed that the strip of wax 6 is of a thickness such that it projects above the top surface of the jig 4.

Figures 3, 4:
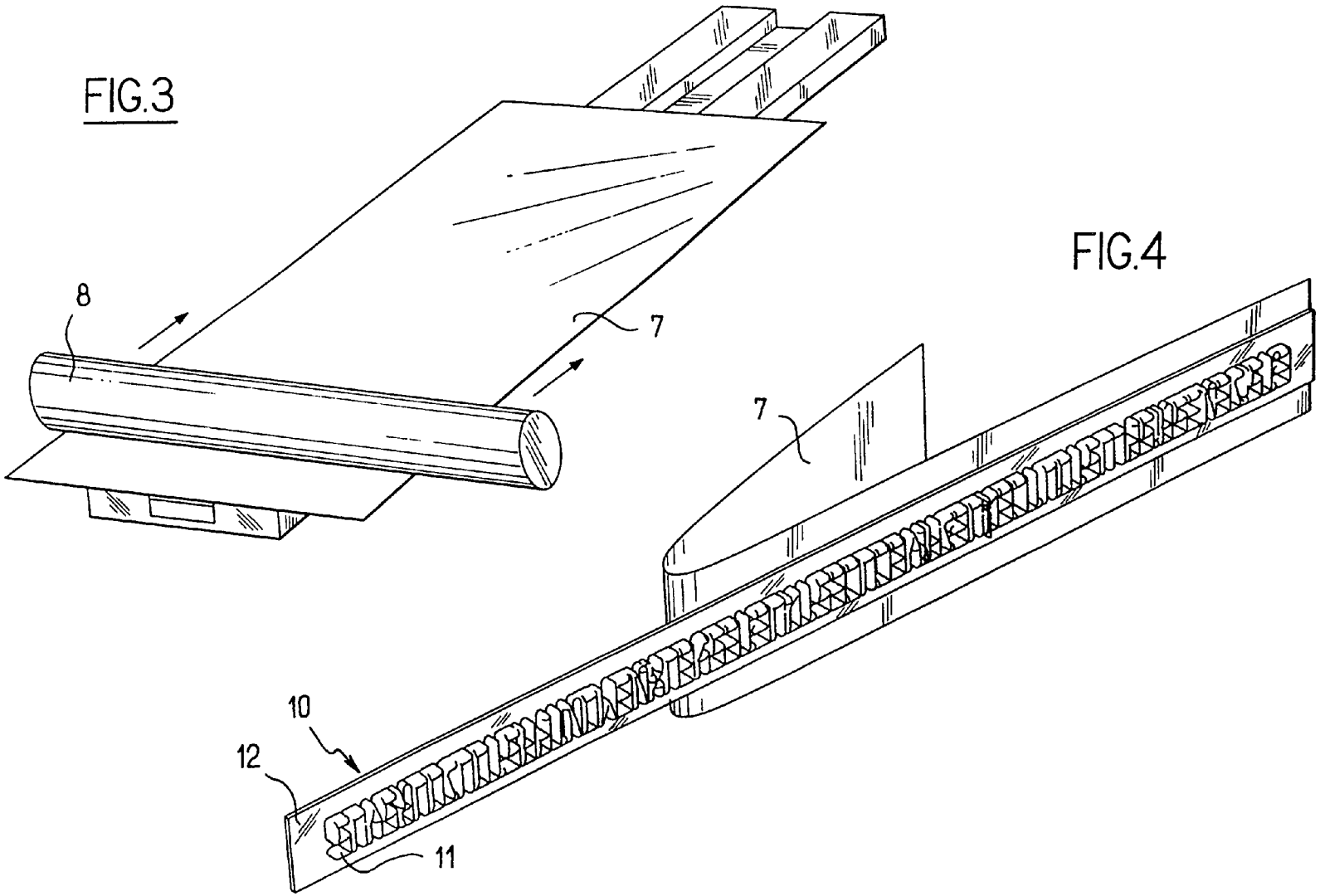
FIG. 3 is a perspective view of the jig shown during the wax-pressing operation.
FIG. 4 is a perspective view of the male shape obtained as a result of the pressing, together with the stiffening backing plate.

As can be seen in FIG. 3, the strip of wax 6 is covered in a sheet of paper 7, and then the strip of wax 6 is pressed into the impression 2, e.g. by rolling a cylinder 8 over the top surface of the jig 4.

The wax 6 then penetrates into the impression 2 while forming a backing plate of thickness defined between the top surface of the plate 1 and the top surface of the jig 4 on which the cylinder 8 rolls. In this respect, the flanks 9 of the recess 5 (visible in FIG. 2) form a mold for said backing plate.

As can be seen in FIG. 4, the above operation serves to obtain a male wax shape 10 comprising a sequence of patterns 11 in relief projecting from a backing plate 12. The sheet 7 adheres to the backing plate 12 during the pressing operation, thus making it easy to extract the male shape 10 from the jig 4. It then suffices to peel off the sheet of paper 7 so as to separate it from the male shape 10, as shown.

The resulting male shape is sufficiently stiff to enable it to be handled and molded easily.

In addition, and in conventional manner, the male shape 10 as obtained in this way is preferably molded using the lost wax molding technique. The material used for molding could be silver or even gold, for example.

The backing plate 12 occupies a space in the mold that enables a plurality of feed points to be organized, thereby greatly facilitating the molding of patterns that are so small.

Figure 5:
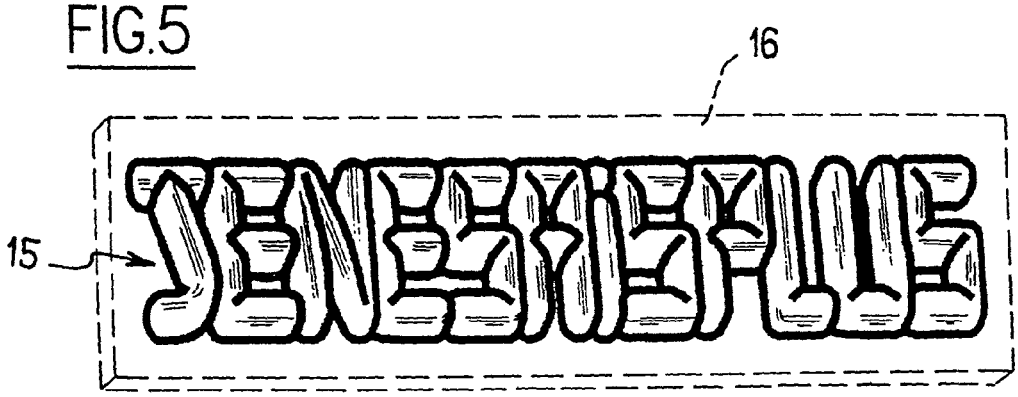
FIG. 5 is a perspective view of a string of patterns obtained using the invention.

This produces a casting of appearance that is entirely similar to that of the male shape 10, i.e. that includes a base 16 (outlined in dashed lines in FIG. 5) from which the string of patterns 15 projects in relief.

In order to obtain particularly attractive finishing, the base 16 is cut away, e.g. by milling, so as to leave behind only the string of patterns 15 forming an alternation of solid junctions and hollow portions.

This string of patterns can be used directly, e.g. for making jewelry. Nevertheless, because of its small size it is relatively fragile. It is therefore advantageous to stiffen such a string of patterns.

Figure 6:
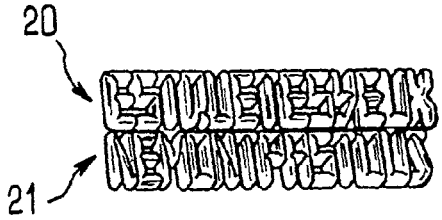

In this respect, and in a particular implementation of the method of the invention, two string portions touching each other via their edges are molded together. To do this, it suffices to engrave two touching impressions in the plate 1. FIG. 6 shows the resulting casting, presenting two pattern string portions 20 and 21 touching via their edges, with the common base cut away therefrom. Each of the pattern string portions forms stiffening means for the other pattern string portion, such that the pair of strings is much stiffer than a single string.

In a variant, it is possible to bond together two pattern string portions edge to edge.

Figure 7:
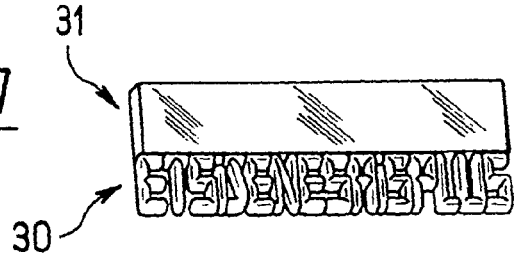
FIGS. 6 to 8 show various ways in which a string of patterns can be used to make pieces of jewelry.

In another particular implementation of the method of the invention, as shown in FIG. 7, in order to stiffen a pattern string portion 30, it is also possible to place it adjacent to a stiffening support 31.

In a first variant implementation, the plate 1 is hollowed out so as to form a recess therein that extends along one of the edges of the sequence of patterns 2. The recess serves to mold the stiffening support directly with the string of patterns.

In a second variant implementation, once the string of patterns has been molded, a separate stiffening support is placed against one of the edges of the string of patterns and the support is connected to the string via a few spot welds.

Figure 8:
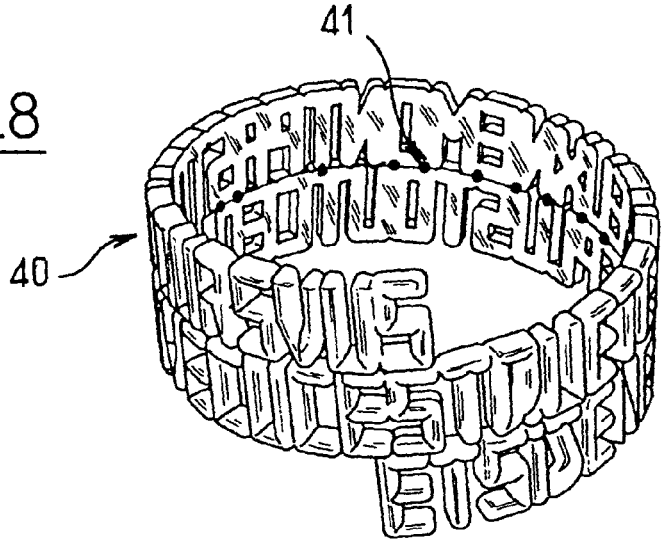

In yet another particular implementation of the method of the invention, as shown in FIG. 8, the string of patterns 40 is shaped into a helix of touching turns, and the turns of the helix as formed in this way are bonded together edge to edge. Spot welds 41 (only one of which is referenced) can be seen that are made on the rear face of the string, so as to be invisible from the outside. This produces a ring of particularly attractive appearance.

All of these embodiments make it possible to make strings of patterns available that are particularly stiff and suitable for use in making jewelry.

Figure 9:
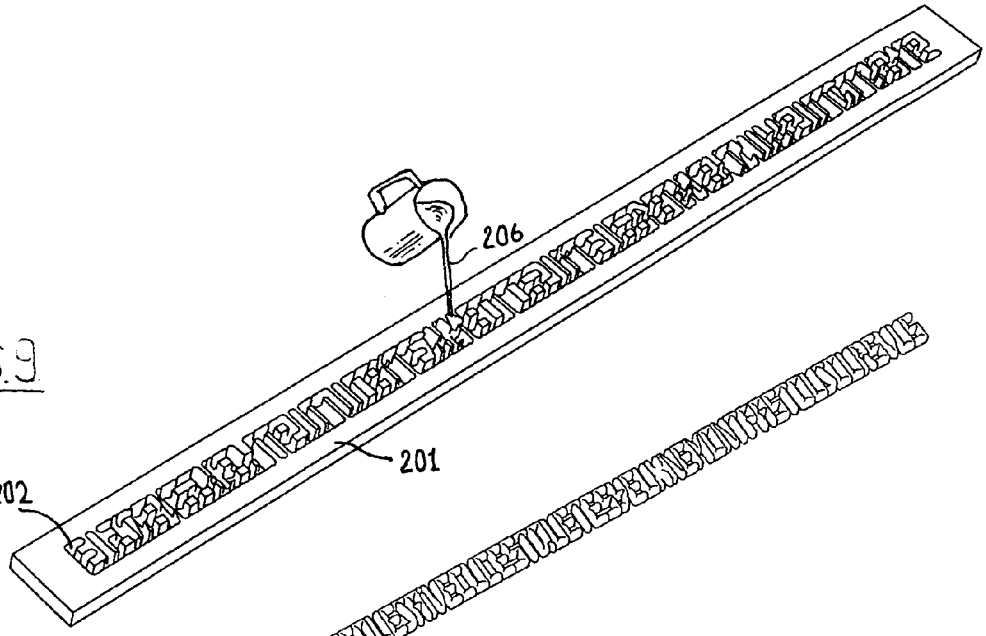
FIG. 9 is a perspective view of a slab in the form of a plate in which an impression has been made in order to perform the method of the invention in a second particular implementation thereof.

With reference to FIG. 9, and in a second particular implementation, the method of the invention includes a step of hollowing out an impression 202 in a slab, in this case a plate 201 of wax, which presents the advantage of being suitable for being remelted after it has been used. The use of wax for the slab also presents the advantage of enabling machining to be performed very quickly.

The impression 202 comprises a sequence of alphabetic patterns that touch one another so as to overlap slightly. The sequence of patterns is obtained in the same manner as above by engraving the plate 201.

Thereafter, a liquid resin 206 is cast into the impression 202 (e.g. a polyurethane resin) that is selected to be sufficiently fluid to ensure that it fills all of the recesses in the impression 202 completely. Prior to filling the impression 202 with the liquid resin 206, it is preferable to spray a jet of silicone from a spray can so as to facilitate unmolding.

Figure 10:
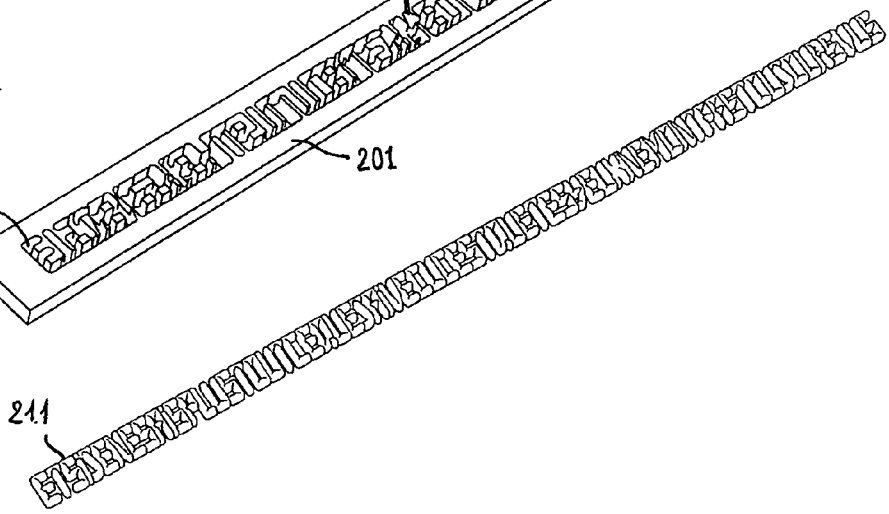
FIG. 10 is a perspective view of a sequence of resin patterns obtained using the plate of FIG. 9.

Once the resin 206 has solidified, it is unmolded and a sequence of patterns 211 is obtained as shown in FIG. 10. During unmolding, it is possible to deform the plate 201 to some extent and even, should molding turn out to be difficult, it is possible to raise the temperature of the plate so as to expand it slightly.

Figure 11:
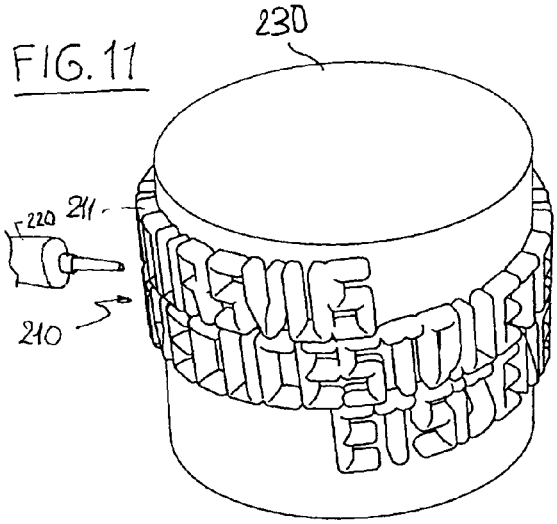
FIG. 11 is a perspective view of the sequence of patterns being wound around a template in order to stiffen the sequence of patterns.

Thereafter, and as shown in FIG. 11, the sequence of patterns 211 is wound helically around a cylindrical template 230 so as to present touching edges. Preferably, the resin is selected to be of the type that is flexible in the solid state so that the sequence of patterns 211 is easily deformable.

Figure 12:
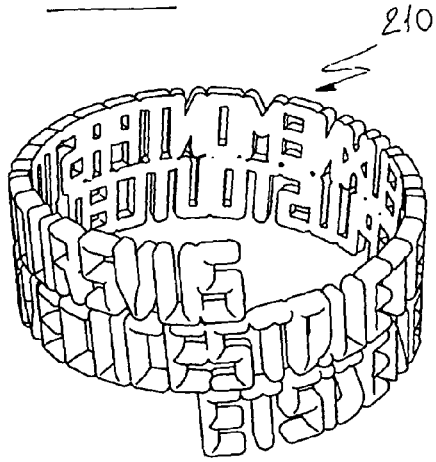
FIG. 12 is a perspective view of the male shape obtained from the wound sequence of patterns of FIG. 11.

The touching edges of the sequence of patterns 211 are stuck together, e.g. using cyanolite adhesive 220. This produces a male shape 210 that can be seen more particularly in FIG. 12 that is much stiffer than the sequence of patterns 211, and thus easy to manipulate.

The male shape 210 is preferably immersed in a bath of solvent in order to remove any excess adhesive. It then remains to mold the male shape 210, preferably by lost wax molding, in order to obtain directly a metal ring constituted by a string of patterns helically-wound with touching turns bonded together by molding.

By way of example, injection points can be provided through the inside face of the ring which presents a large area making it easier to deliver metal. Once the ring has been molded, it then suffices to cut away any traces of injection that are situated on the inside face of the ring and that are therefore not visible from the outside.

The resulting piece of jewelry is very strong and does not present the weaknesses inherent to the bonding used in the first-described implementation.

The invention is not limited to the above description and covers any variant coming within the ambit defined by the claims.

In both implementations described, the method of the invention thus comprises a step of making an intermediate piece, specifically the male shape, which comprises a sequence of patterns stiffened to enable it to be handled and molded. Stiffening is obtained by making a backing plate or by shaping the sequence of patterns into a helix and connecting together its edges. Nevertheless, the invention is not limited to these particular types of stiffening, and any other type of stiffening can be envisaged, for example adhesively-bonding a plastics plate to the back of a sequence of patterns obtained by casting liquid resin into the impression.

In addition, even though the impression made in the acetate sheet in the first implementation does not pass through the sheet, thus making it possible to provide rounded edges for the patterns by using an engraving tool with a rounded tip, it is naturally also possible to make an impression with through holes, the wax then being stopped by the bottom of the recess in the jig.

Although in the first implementation, it is stated that the slab is a plate cut from a sheet of acetate, it is possible to use any other material, e.g. a block of aluminum. It is also possible to use a micro-perforated plate, so as to allow the air that is imprisoned by the strip of wax to escape while the strip of wax is being pressed into the impression.

It is also possible to use a plate of wax that is harder than the wax used for forming the male shape.

Although it is stated in the first implementation that the molding base is completely cut away in order to obtain a string of patterns presenting structural strength that is due solely to the connections between the patterns, it is also possible to cut away the base only partially so as to leave a web under the patterns. Although less satisfactory from the point of view of appearance, it is also possible to leave the entire base.

Although it is stated that the connection between the string of patterns cast in metal and the stiffening support is obtained directly by molding, or by spot welding, it is also possible to perform welding continuously along the edge, or indeed to perform bonding by other means, e.g. by using adhesive.

Although the patterns shown are letters, it would naturally be possible to reproduce patterns other than letters, the patterns preferably being selected from a pattern base thus making it possible to determine quickly the sequence of patterns that is to be reproduced. For example, it is possible to offer patterns in the form of crosses, circles, or any other imaginable pattern.

Although it is stated that the impression is obtained using an engraving tool controlled by a computer, it is also possible to obtain the impression by other means, e.g. by photoetching or indeed by pressing punches into a malleable material, each punch forming one determined pattern.

Although the sequence of patterns of the male shape is obtained by using a material for taking the shape of the impression that is constituted by the strip of wax or by the liquid resin, any other material suitable for filling the impression in the slab could be used, such as a hardenable sealing compound.

The invention claimed is:

1. A method of obtaining a string of patterns, comprising the steps of:

hollowing out an impression in a slab, which is made of wax, the impression comprising a sequence of patterns touching one another;

causing a material for taking the shape of the impression to penetrate into the impression so as to obtain a sequence of patterns in relief and deformable, said material is liquid resin which is selected to be of the type that is flexible in the solid state;

stiffening the sequence of patterns to obtain a male shape suitable for being molded the stiffening step comprising the operation of deforming the sequence of patterns so as to cause edges of the sequence of patterns to face one another and securing said edges to one another; and making a molding of the male shape.

2. A method according to claim 1, in which the deformation comprises the operation of winding the sequence of patterns to form a helix with touching turns, the facing edges being secured to one another.

* * * * *